US005143311A

United States Patent [19]

Laster

[11] Patent Number: 5,143,311

[45] Date of Patent: Sep. 1, 1992

[54] WOOD SHAVINGS FORMING APPARATUS AND CUTTING ROLL ADAPTED FOR USE THEREWITH

[75] Inventor: James E. Laster, Greensboro, N.C.

[73] Assignee: Newman Machine Company, Inc., Greensboro, N.C.

[21] Appl. No.: 525,148

[22] Filed: May 17, 1990

[51] Int. Cl.[5] ..... B02C 18/22; B02C 18/18

[52] U.S. Cl. ..... 241/280; 144/172; 241/286; 241/294

[58] Field of Search ..... 407/61, 58, 43, 51, 407/56; 144/172, 174, 181, 230; 241/280, 294, 242, 28, 222, 239, 240, 281, 282, 286

[56] References Cited

U.S. PATENT DOCUMENTS

| | | | |
|---|---|---|---|
| Re. 32,355 | 2/1987 | Warren et al. . | |
| Re. 32,363 | 2/1987 | Warren et al. . | |
| 139,804 | 6/1873 | Mills et al. . | |
| 293,150 | 2/1884 | Cummings . | |
| 557,727 | 4/1896 | Tracy et al. . | |
| 877,690 | 1/1908 | Williams . | |
| 895,219 | 8/1908 | Wittemore et al. | 144/230 |
| 938,734 | 11/1909 | Williams et al. . | |
| 1,630,021 | 5/1927 | Lucas . | |
| 1,691,983 | 11/1928 | Miller . | |
| 1,736,622 | 11/1929 | Randall . | |
| 2,292,901 | 8/1942 | Schmitz, Jr. . | |
| 2,360,854 | 10/1944 | Dodge . | |
| 2,710,635 | 6/1955 | Alexander | 241/280 X |
| 2,813,557 | 11/1957 | Thompson | 241/280 X |
| 2,874,912 | 2/1959 | Senholtz et al. . | |
| 2,889,861 | 6/1959 | Kolimbat | 144/230 X |
| 3,037,540 | 6/1962 | Bloomquist et al. | 241/294 X |
| 3,195,592 | 7/1965 | Hall | 144/172 |
| 3,356,114 | 12/1967 | Noel | 144/172 |
| 3,515,358 | 6/1970 | Sato . | |
| 3,679,143 | 7/1972 | Montgomery . | |
| 3,785,417 | 1/1974 | Vora . | |
| 3,933,314 | 1/1976 | Luscombe . | |
| 3,938,746 | 2/1976 | Nordgren . | |
| 4,030,865 | 6/1977 | Kobayashi . | |
| 4,074,737 | 2/1978 | Stewart | 144/230 X |
| 4,347,988 | 9/1982 | Warren et al. . | |
| 4,454,995 | 6/1984 | Bloomquist | 241/294 X |
| 4,470,442 | 9/1984 | Krautzberger et al. | 241/294 X |
| 4,657,192 | 4/1987 | Browning . | |
| 4,702,426 | 10/1987 | Citterio . | |
| 4,776,375 | 10/1988 | Arasmith . | |
| 4,802,631 | 2/1989 | Arasmith . | |

FOREIGN PATENT DOCUMENTS

| | | | |
|---|---|---|---|
| 232292 | 2/1910 | Fed. Rep. of Germany | 241/280 |

*Primary Examiner*—Mark Rosenbaum
*Attorney, Agent, or Firm*—Bell, Seltzer, Park & Gibson

[57] ABSTRACT

An apparatus for forming wood shavings from wood stock includes a rotatable cutting roll for engaging and cutting wood shavings from a wood stock advanced by a feed mechanism along a predetermined path of travel to the roll. A rotatable roll of the feed mechanism has peripheral teeth that engage the wood stock and control its advancement along the path of travel. The teeth are inclined rearwardly relative to the direction of rotation of the roll so that the teeth have a negative rake angle. An anvil is positioned adjacent the end of the path of travel and closely adjacent the cutting roll for restricting advancement past the cutting roll of pieces of wood stock other than the shavings.

22 Claims, 5 Drawing Sheets

WOOD SHAVINGS FORMING APPARATUS AND CUTTING ROLL ADAPTED FOR USE THEREWITH

FIELD OF THE INVENTION

This invention relates to an apparatus for forming wood shavings from wood stock and more particularly, to an apparatus for forming wood shavings from wood stock where the apparatus includes a rotatable cutting roll for engaging and cutting wood shavings from the leading edge portion of wood stock advanced along a predetermined path of travel to the roll and feed means adjacent the path of travel for controlling the advancement of the wood stock along the path of travel.

BACKGROUND OF THE INVENTION

Wood shavings commonly are produced for use in animal bedding, mulch mixtures, starting fuels, and other products where wood shavings are desirable. Additionally, large landfills sometimes do not permit the dumping of large pieces of wood stock therein. As a result, large pieces of wood stock sometimes must be cut into smaller shavings for landfill dumping.

Typically, machines for producing wood shavings have a rotatable cutting roll with cutting knives positioned on the periphery thereof for engaging wood stock advanced thereto along a predetermined path of travel by rotatable feed rolls. If the rate of advance of the wood stock is not properly controlled, it may engage the smooth periphery at the cutting roll. This may create charring of the wood.

The rate at which the wood stock is advanced to the cutting roll must be synchronized with the speed of the cutting roll. If the wood stock is advanced too rapidly, its leading end portion will engage smooth surface portions of the cutting roll and become charred by the frictional heat generated as a result of such engagement. Too rapid advancement may also result in the cutting roll compressing and fracturing the wood stock, and violently propelling broken fragments of it. The foregoing undesirable results can ensue even when the rotational speeds of the cutting and feed rolls are properly synchronized, if significant slippage occurs between the wood stock and the feed rolls, or if terminal sections of the wood stock is not prevented from being moved rapidly forward by the cutting roll.

SUMMARY OF THE INVENTION

The present invention provides an improved wood shavings forming apparatus wherein the possibility of the wood stock being charred, compressed, fragmented and/or violently propelled by the cutting rolls is greatly reduced, if not all together eliminated. Feed means provided adjacent the path of travel of the wood stock for controlling its advancement to the cutting roll of the apparatus includes at least one rotatable feed roll having peripheral teeth that are engageable with the wood stock and are inclined rearwardly relative to the direction of rotation of the first feed roll so as to have a negative rake angle. A negative rake angle in the range of 5° to 20° is preferred. The aforesaid feed roll preferably underlies and is closely adjacent the cutting roll.

In the preferred embodiment of the apparatus, an anvil is positioned adjacent the end of the path of travel and closely adjacent the cutting roll for restricting advancement past the cutting roll of pieces of wood stock other than the shavings. The anvil preferably is mounted for adjustive movement toward and away from the cutting roll.

The cutting roll of the apparatus preferably includes a plurality of slots within and spaced about the peripheral surface of the roll. Each cutting element includes a base member receivable within one of the slots. The relative dimensions of the base member and slot permit the insertion of shims in the slots so as to vary the projection of the cutting elements. Each base member includes a top surface having a carbide blade insert extending obliquely there across.

DESCRIPTION OF THE PRIOR ART

A wood shavings producing machine having a feed bed and feed rollers for advancing wood stock to a rotating cutting roll is disclosed in U.S. Pat. No. 3,679,143 to Montgomery. The feed rolls have serrated teeth for engaging the wood stock. A fodder shredder having pinch feed rolls for feeding material to a rotating shredder is disclosed in U.S. Pat. No. 557,727. Wood shredding and other shredding mechanisms having rolls for advancing material into engagement with cutting mechanisms are disclosed in U.S. Pat. Nos. 4,702,426; 4,030,865; 3,933,314; 3,938,746; 3,515,358; 2,360,854; 2,292,901; 1,736,622; 938,734; 877,690; 293,150; and 139,804.

A rotor assembly having longitudinal channels of dovetail configuration with the channels each mounting a series of knife blades and separated by and clamped between adjacent spacer elements is disclosed in U.S. Pat. No. 3,866,844. A rotary cutting tool having a head which includes a plurality of helical slots which mount individual cutting blades is disclosed in U.S. Pat. No. 3,785,417. Other cutting rolls and assemblies are disclosed in U.S. Pat. Nos. 4,802,631; 4,776,375; 4,657,192; 2,874,912; 1,691,983; 1,630,021; 32,363; and 32,255.

BRIEF DESCRIPTION OF THE DRAWINGS

Other features of the invention will be apparent from the following description of an illustrative embodiment thereof, which should be read in conjunction with the accompanying drawings in which.

DETAILED DESCRIPTION OF THE PREFERRED EMBODIMENTS

Figure 1:
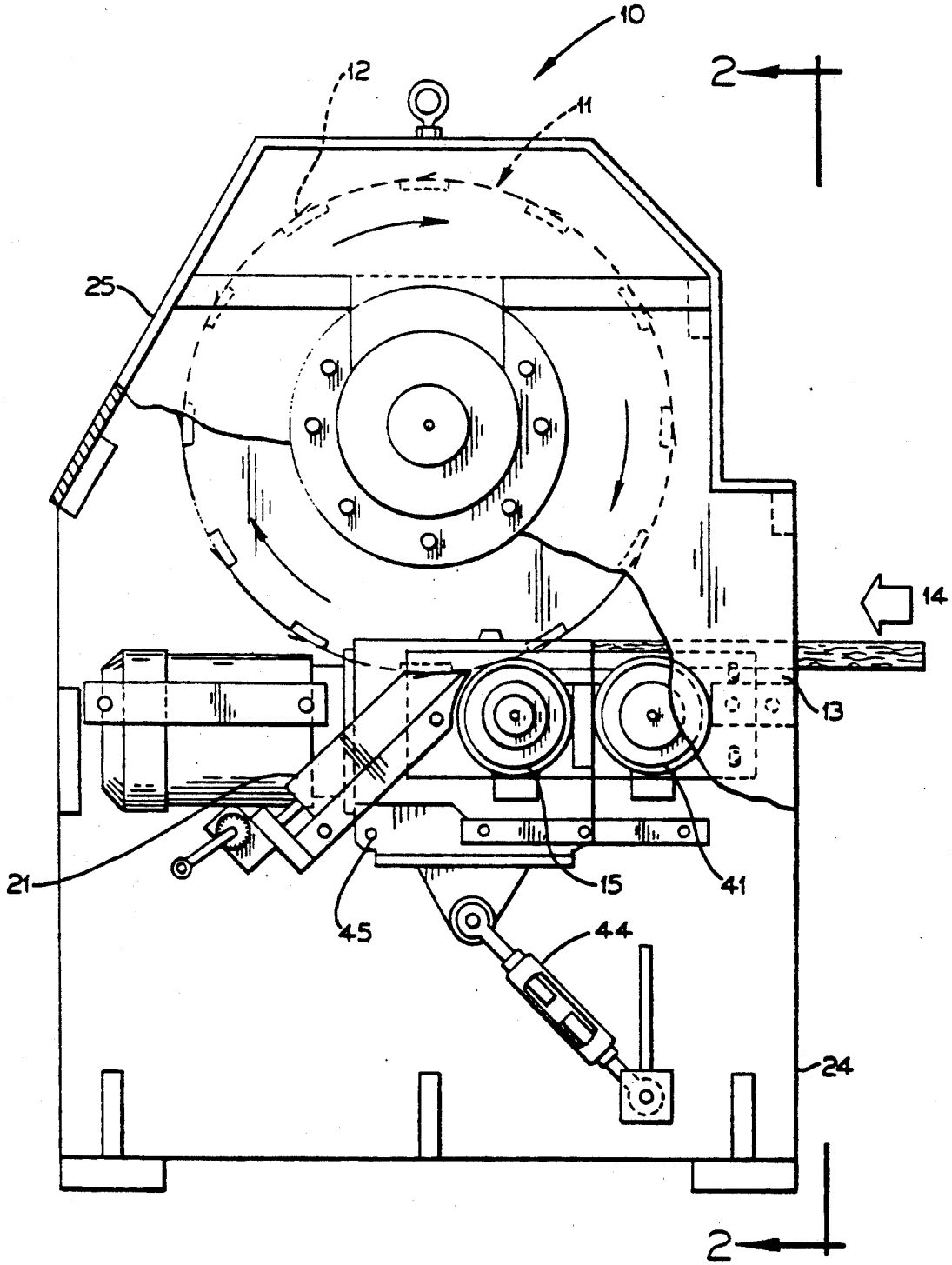
FIG. 1 is a side elevation of the apparatus for forming wood shavings in accordance with the present invention.
Figure 2:
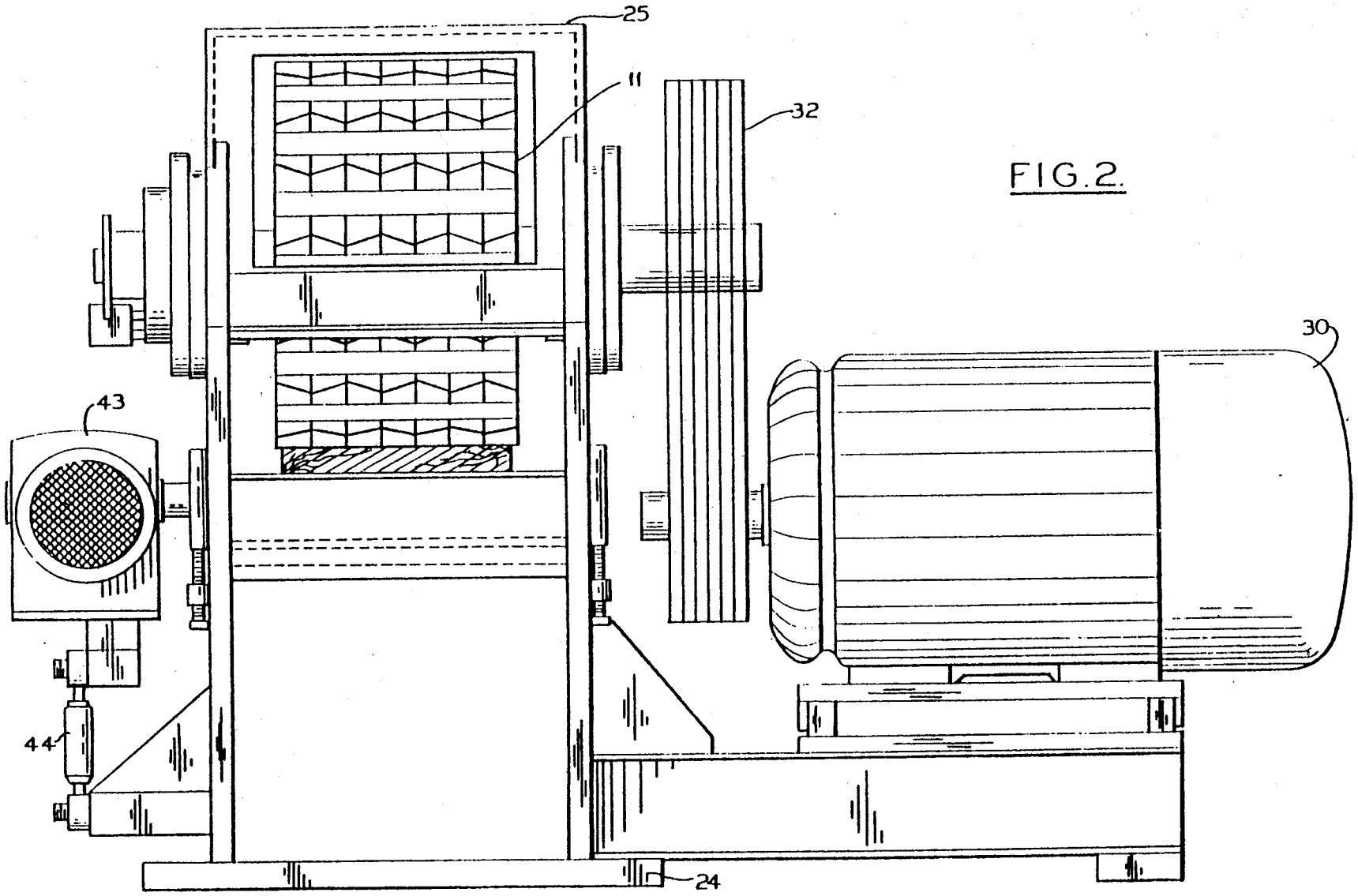
FIG. 2 is a front elevational view taken along line 2—2 of FIG. 1.

Referring now to the drawings, and more particularly to FIG. 1, the apparatus for forming wood shavings from wood stock W in accordance with the present invention is indicated generally at 10. The apparatus includes a rotatable cutting roll 11 having a plurality of cutting elements 12 projecting from the peripheral surface of the roll for engaging and cutting wood shavings from the leading edge portion of wood stock advanced on a planar feed bed 13 along a predetermined path of travel to the roll. Feed means is positioned adjacent the path of travel for controlling the advancement of the wood stock W therealong in the direction of the arrow 14, which feed means includes at least one and illustratively a plurality of rotatable feed rolls 15, 41 which engage the wood stock. Drive means, which includes drive motors 30, 43, imparts rotation at desired speeds to the cutting and feed rolls, and anvil means 21 is positioned adjacent the end of the path of travel and closely adjacent the cutting roll 11 for restricting advancement past the cutting roll of pieces of wood stock other than wood shavings (FIG. 2).

The cutting roll 11 of apparatus 10 is mounted by suitable bearings adjacent the downstream (left, as viewed in FIG. 1) end of a planar bed 13 upon which the wood stock rests during advancement thereof to the roll 11. During operation of the apparatus 10, rotative movement in the direction of arrows is imparted to the cutting roll 11 by suitable transmission means in the form of a belt 32 (FIG. 2). The cutting roll 11 is mounted for rotation above the bed so that only a lower portion of the cutting roll cutting surface forming the cutting circle of the roll extends below the plane of the bed. Additionally, a frame 24 supports the bed 13 and is enclosed by a housing 25.

Figure 5:
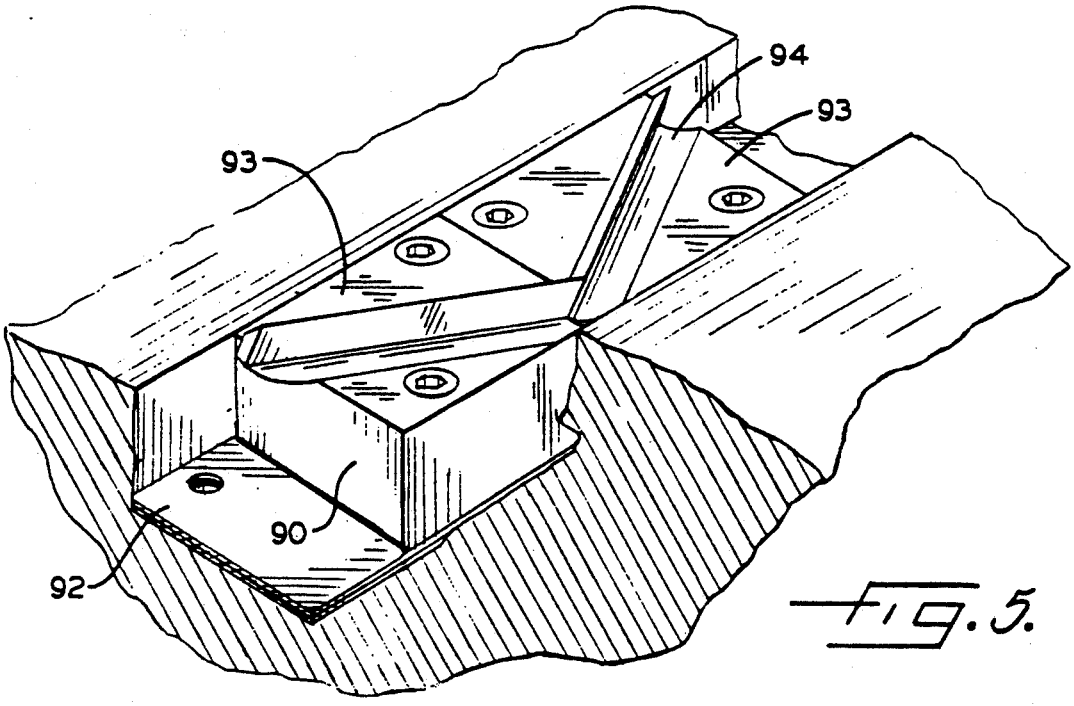
FIG. 5 is an enlarged fragmentary perspective view showing shims and cutting elements of the cutting roll.
Figure 8:
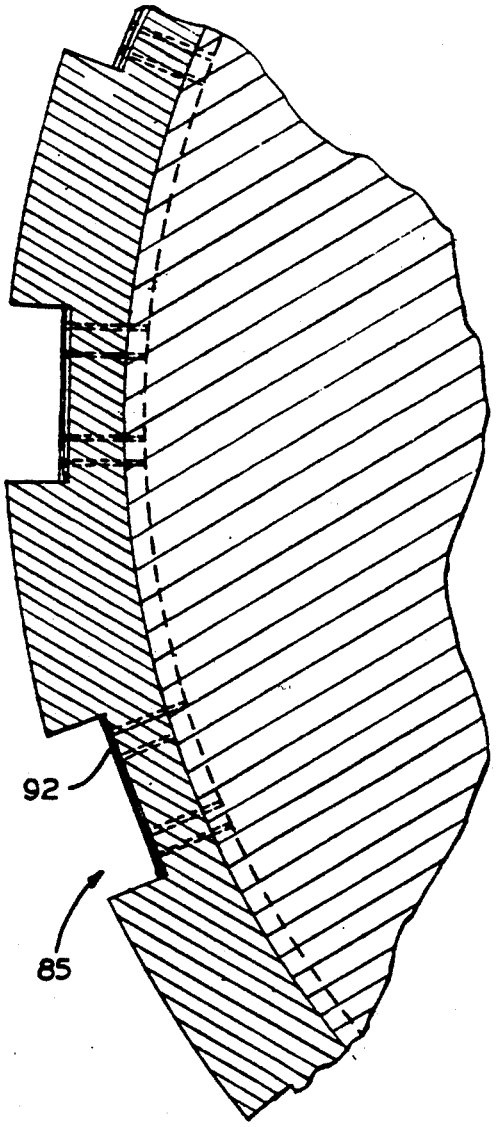
FIG. 8 is an enlarged fragmentary sectional view of the slots of the cutting roll.

As shown in FIG. 8, the cutting roll includes a plurality of slots 85 within and spaced about the peripheral surface of the roll. Each cutting element 12 includes a base member 90 which is dimensioned so that the cutting elements 12 are receivable within the slot of the cutting roll 11. The relative dimensions of said base member and the slot permit the extent of projection of the cutting elements 12 from the periphery of the roll 11 circumference to be varied by the placement of shims 92 therein (FIG. 5). Each base member 90 also includes a top surface 93 having a chip gullet 94 extending obliquely across the top surface thereof. The chip gullet 94 is of sufficient volume to resist compression of the shavings.

Figure 6:
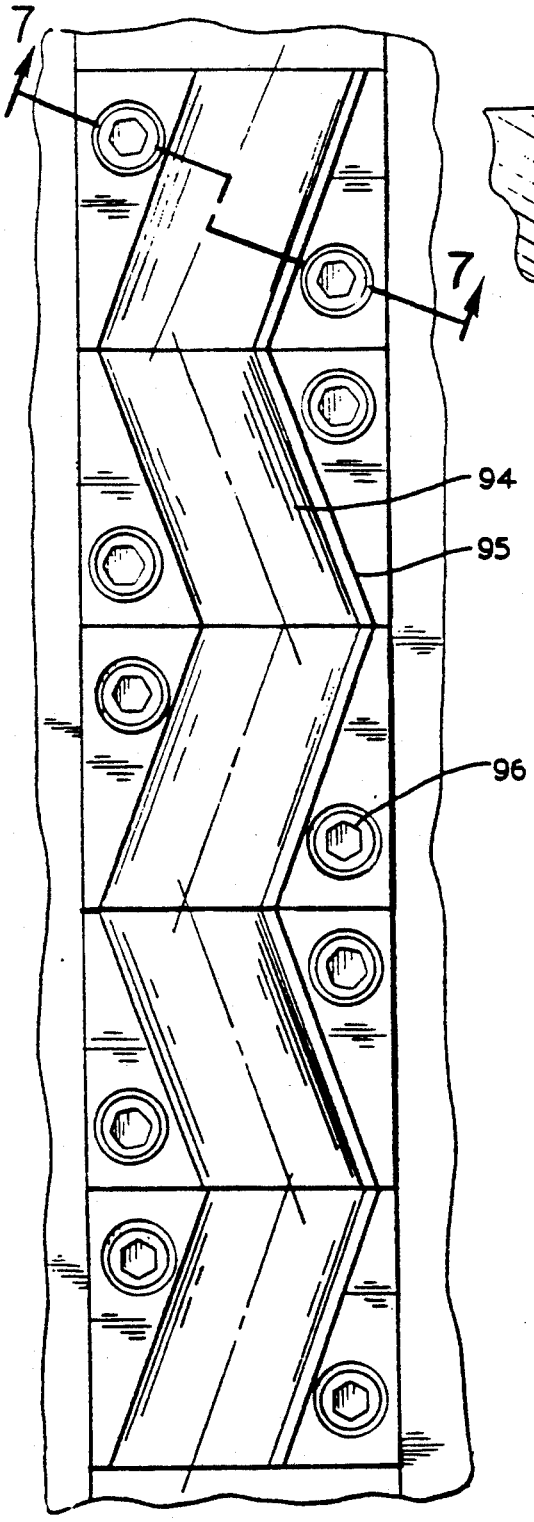
FIG. 6 is a plan view showing a series of five cutting elements in a slot of the cutting roll.
Figure 7:
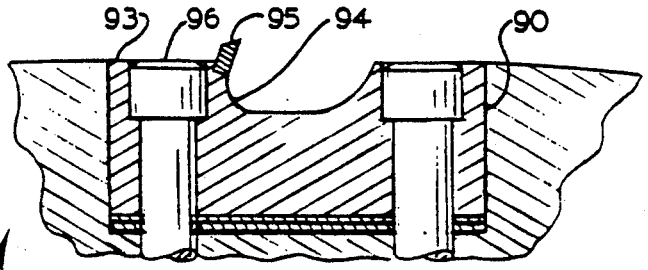
FIG. 7 is an enlarged detail sectional view taken along line 7—7 of FIG. 5.

A carbide blade insert 95 extends obliquely across the top surface parallel and adjacent the chip gullet 94 so as to form a projecting cutting blade which can engage the wood stock W as the cutting roll is rotated. The carbide blade insert 95 can be secured to the base member 90 by appropriate means such as brazing. The base member is secured to the cutting roll 11 within the slots 85 by appropriate cap screws 96. Typically, each base member 90 is about 2 inches square and has a height of about ¾ inch. Depending on the width of the cutting roll 11 across the periphery, a plurality of elements, which are placed side-by-side in staggered relationship so that the inserts 95 alternate to each other. FIG. 6 illustrates 5 elements. An unstaggered positioning of the elements so that the inserts 95 lie in one direction common to each other would create a sideward biasing force on wood stock so that the leading edge would be forced toward the side. The alternating arrangement provides cancelling forces when the cutting elements engage the wood stock so that a sideward biasing force on the wood stock is not produced.

It has been determined that a chip gullet 94 having an approximate ⅝ inch radius and which is ⅜ inch deep is acceptable for use with the present invention. Preferably, the carbide blade insert 95 has an approximate 20° rake angle. The oblique angle defined by the carbide blade insert and the chip gullet relative to the base member is approximately 20°.

Figure 3:
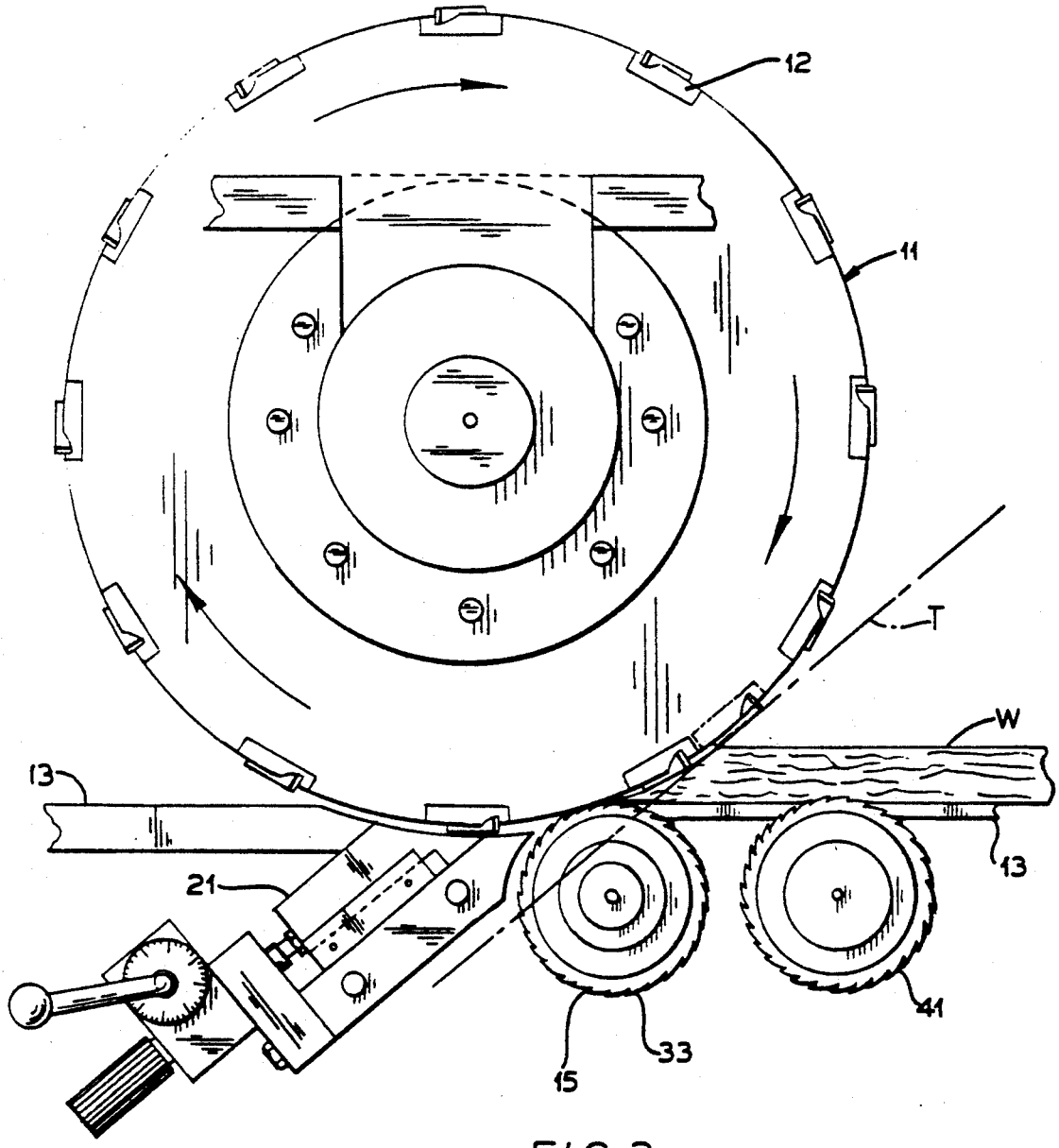
FIG. 3 is an enlarged view primarily in elevation, but partially in section of the cutting roll and feed rolls.

As illustrated in FIG. 3, the wood stock feed means includes a first feed roll 15 closely adjacent the cutting roll 11 and positioned to underlie the cutting roll and path of travel. Preferably, the first feed roll 15 is positioned so that the cutting elements 12 of the cutting roll 11 clear the first feed roll by about 1/32 to 1/16 inch. It is preferable that the lowest portion of the cutting elements are positioned at ⅛ to ⅜ inch below the top surface of the first feed roll 15. Additionally, the first feed roll is positioned so that the resultant force vector of the cutting elements on the leading edge portion of wood stock is in a direction toward the center of the first feed roll 15. This is seen as the cutting roll tangent line T shown on FIG. 3. The first feed roll 15 includes peripheral teeth 33 engageable with the wood stock W advanced along the path of travel. The teeth 33 are inclined rearwardly relative to the direction of rotation of the first roll so that the teeth have a negative rake angle. Preferably the negative rake angle is in the range of 5° to 20°.

Drive means in the form of a variable speed electric motor 43 is fixed to the frame 24 by a torque arm and mount 44. The electric motor is connected to the feed rolls 15, 35 by transmission means illustrated at 45 (FIG. 1). Transmission means includes a linear drive transmission system so that when an electric motor is operated, the peripheral speed of the feed rolls is substantially the same.

The anvil 21 is positioned adjacent the end of the path of travel and closely adjacent the cutting roll 11. The anvil 21 is formed of a material cuttable by the cutting elements of the cutting roll. Aluminum has been found preferable. The anvil has a concave surface 60 confronting and closely adjacent the cutting circle of the cutting roll 11. The anvil 21 is positioned so that a plane normal to the feed bed 13 and containing the central axis of the cutting roll passes through the concave surface 60 of the anvil.

Figure 4:
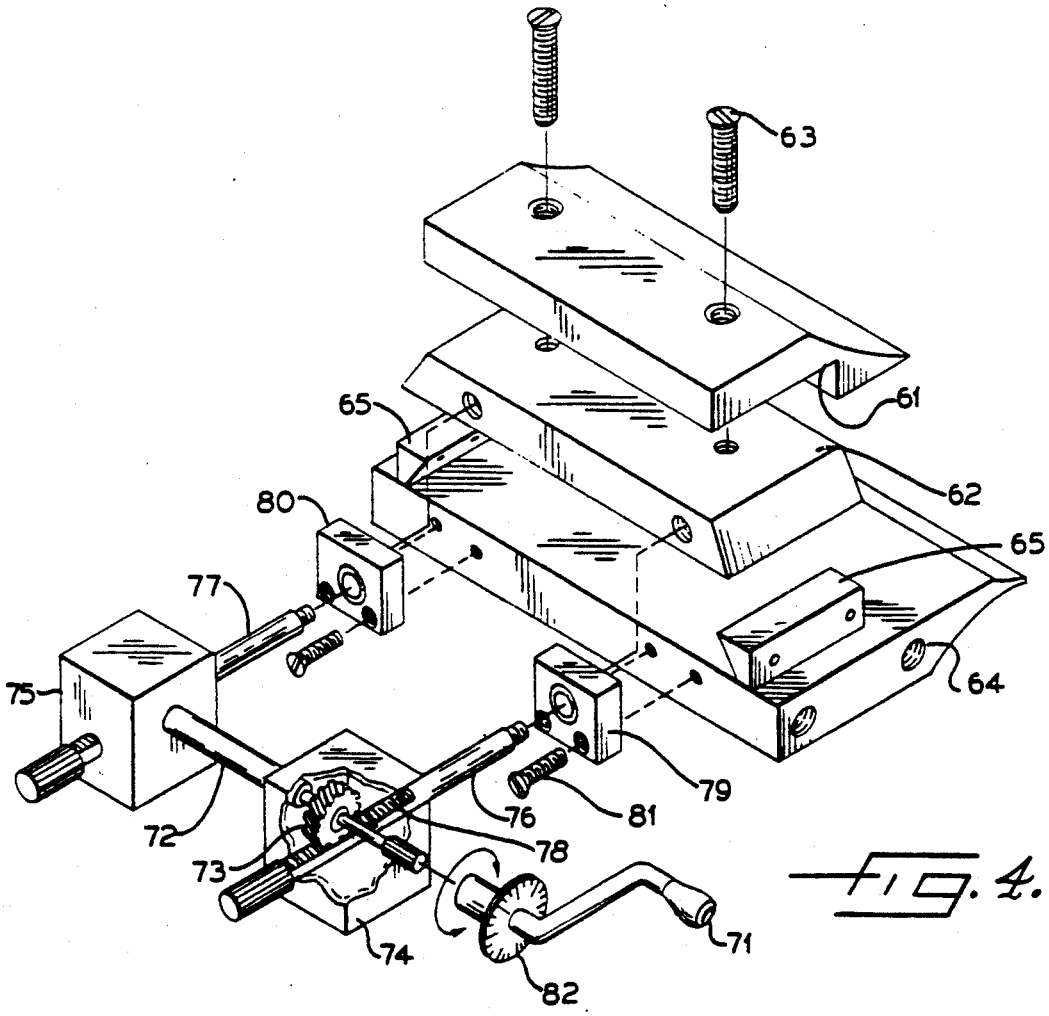
FIG. 4 is a partially exploded perspective view of the anvil, and components which mount the anvil for adjustive movement relative to the cutting roll.

Mounting means 22 mounts the anvil for adjustive movement toward and away from the cutting roll 11 (FIGS. 3 and 4). The mounting means 22 includes an anvil plate 62 which mounts the aluminum anvil 21 thereon. The anvil 21 includes on the undersurface thereof a milled receiving channel 61 which engages the anvil plate 62. Cap screws 63 secure the anvil to the top of the anvil plate 62. The anvil plate 62 is slidably supported by an anvil support 64 secured to the machine frame 24. Opposite sides of the anvil plate 62 are tapered for slidable engagement with opposing angle members 65 forming a dovetail receiving joint on the anvil support 64 so that the anvil plate 62 can be releasably moved within the dovetail joint.

The anvil 21 and anvil plate 62 are adjustably slidable on top of the anvil support 64 by adjustable crank means which includes a handle 71 connected to a shaft 72 having a pinion 73 thereon. The shaft 72 and pinion 73 are supported by two anvil support blocks 74, 75 secured to the anvil support 64. The pinion 73 interconnects the first of two rods 76, 77 mounted in the anvil support blocks 74, 75. A second pinion (not shown) fixed to the shaft 72 can interconnect the second rod 77. Each rod includes a rack 78 engaging a respective pinion 73 fixed on the shaft 72. The rods 76, 77 extend through guide blocks 79, 80 fixed to the anvil support 64 by bolts 81. The rods 76, 77 are threadably secured at their end to the movable anvil plate 62. In operation, when the shaft 72 is rotated, the pinions 73 engaging the racks 78 move the rods 76, 77, thus moving the anvil plate and anvil. The handle 71 also includes a flange 82 having indicia thereon for indicating the extent of movement of the anvil 21 and anvil plate 62 as the handle is rotated.

Method of Operation

To begin operation, the extent of the projection of the cutting elements 12 from the peripheral surface of the cutting roll 11 is established by placing shims 92 of predetermined thickness within each slot 85 or removing shims from the slots, so that the carbide blade insert 95 extends outwardly a predetermined distance to form the cutting circle of the cutting roll. The maximum distance the cutting edge of the carbide blade insert 95 can extend outwardly from the cutting roll periphery is usually about 0.060 inches and typically is set at about 0.030 inches. Too great a distance provides too deep a cut on advancing wood stock which can cause gouging and poor shaving quality. After the desired shim or shims 92 have been inserted within each slot 85, they and the base member 90 are secured to the cutting roll 11 by cap screws 97.

The arcuate anvil surface adjacent the cutting roll may be formed to the arcuate curve of the cutting roll by cutting the anvil 21 with the cutting roll 11. Initially, the aluminum anvil 21 is moved into engagement with the rotating cutting roll by turning the handle 71. The anvil 21 is machined by the cutting elements 12 to have a concave surface complementary to the outer arcuate surface of the cutting roll.

The feed roll electric motor 43 is then activated so that the transmission turns the feed rolls 15, 41. Wood stock is inserted within the apparatus on the feed bed 13. Depending on the desired design, a plurality of other feed rolls (not shown) can advance the wood stock to the first feed roll 15. As advancement of wood stock W continues along the path of travel, it is engaged by the negative rake teeth 33 of the first feed roll 15 and by the cutting blades of cutting roll 11. The resultant force vector defined in FIG. 3 by the cutting roll tangent line T is exerted against the center of the first feed roll 15 so that the forces generated against the wood stock are generated downwardly onto the first feed roll 15 causing the negative rake teeth to bite into the wood stock.

The feed rolls 15, 41 operate at a common peripheral speed synchronized with and less than the peripheral speed of the cutting roll 11. The selected synchronized speeds of the feed rolls 15, 41 and of the cutting roll 11 can be varied adjustably to accomodate wood stock W of different thickness, hardness and the like. Shaving thickness also can be varied by changing shims 92 to vary the projection of the carbide blade insert 95 outward from the peripheral surface of the cutting roll 11.

As illustrated in FIG. 3, the anvil 21 restricts advancement past the cutting roll of pieces of wood stock W other than the shavings. In operation, the cutting roll 11 exerts tremendous forces upon the leading edge portion of the wood stock W. The leading edge portion of the wood stock typically is very thin as shown in FIG. 3, and the forces generated by the cutting roll 11 on the thin, shaved end portion of the wood stock W can cause the end portion to break away therefrom. Without the anvil 21, the broken pieces of the wood could be violently discharged by the cutting roll 11. The anvil restricts the advancement past the cutting roll of pieces of the wood stock W larger than the shavings and can also provide an additional support to the wood stock so that the excessive force generated thereon by the cutting roll will not tear the wood stock leading edge.

It has been found that the apparatus in accordance with the present invention can cut a wood shaving up to three inches in length with a desired thickness of approximately 0.030 inches. These figures can change depending on the size of the cutting roll 11, the extent of the projection of the carbide blade insert 95 from the periphery of the cutting roll 11, and the speed of the first feed roll 15 and associated other feed rolls. During the cutting operation, the formed shaving curls in the chip gullet 94 and is then discharged Outwardly from the cutting roll 11.

The apparatus in accordance with the present invention offers several benefits over prior art apparatus. The negative rake of the first feed roll 15 provides greater control over the advancement of wood stock W to the cutting roll 11. The cutting roll 11 exerts tremendous forces on the wood stock W and tends to pull the wood stock in a direction along the path of travel. The negative rake provides enhanced control to aid in retarding the advancement of the wood stock for producing higher quality shavings.

Additionally, the anvil 21 prevents fragmentation and violent discharge of pieces of wood stock W even after it passed by the last feed roll. The anvil is positioned in close proximity to the cutting roll 11 and provides the necessary means to restrict advancement past the cutting roll 11 of pieces of wood stock W which could be broken and violently jettisoned away from the cutting roll 11. Additionally, the anvil 21 can provide additional support for the leading edge portion of the wood stock W to prevent tearing of the thinner, leading edge portion thereof.

The novel construction of the cutting roll 11 having the cutting elements 12 as disclosed provides greater control over the extension to which the carbide blade insert 95 or other knife-like edge projects outward from the periphery of the cutting roll 11. Shims 92 can be manufactured to exact, predetermined sizes to facilitate control over the amount of projection of the cutting elements 12.

While a preferred embodiment of the invention has been shown and described, this was for purposes of illustration only and not for purposes of limitation, the scope of the invention being in accordance with the following claims.

What is claimed is:

1. Apparatus for forming wood shavings from wood stock, comprising:

a rotatable cutting roll having a generally cylindrical peripheral surface, and a plurality of cutting elements projecting from said surface for engaging and cutting wood shavings from the leading edge portion of wood stock advanced along a predetermined path of travel to said roll, and feed means adjacent said path of travel for controlling the advancement of the wood stock along said path of travel, said feed means including a first rotatable roll positioned closely adjacent said cutting roll and below said path of travel and substantially underlying said cutting roll and having peripheral teeth engagable with the wood stock advanced along said path of travel, said teeth being inclined rearwardly relative to the direction of rotation of said first roll such that said teeth have a negative rake angle in the range of 5° to 20° and wherein said first feed roll is positioned so that the resultant force vector of said cutting elements on the leading edge portion of wood stock advanced along the predetermined path of travel is in a direction toward said first feed roll.

2. The apparatus as claimed in claim 1, and further including drive means for during operation of said apparatus imparting rotation to said cutting roll and to said first roll of said feed means.

3. The apparatus as claimed in claim 2 wherein said drive means synchronizes the peripheral speeds of said cutting roll and said feed roll such that the leading edge of the wood stock engages said cutting elements projecting from said surface of said cutting roll without engaging said peripheral surface thereof.

4. The apparatus as claimed in claim 3 wherein said drive means rotates said first feed roll at a peripheral speed less than the peripheral speed of said cutting roll.

5. The apparatus as claimed in claim 3 wherein said drive means includes at least one adjustable variable speed drive mechanism for rotating said first feed roll at different selected speeds.

6. The apparatus as claimed in claim 1 wherein said feed means further includes at least a second feed roll having teeth with a negative rake angle.

7. The apparatus according to claim 1 wherein said feed means further includes a fixed, substantially planar bed upon which said wood stock rests during advancement thereof along said path of travel, said peripheral teeth of said first feed roll extending above said surface of said bed for engaging said wood stock resting thereon.

8. The apparatus according to claim 1 wherein said feed means includes a fixed, substantially planar bed upon which said wood stock rests during advancement thereof along said path of travel, said cutting roll being mounted for rotation above said bed so that only a lower portion of said cutting roll cutting surface extends below the plane of said bed.

9. The apparatus according to claim 1 wherein said cutting roll includes (a) a plurality of slots within and spaced about the peripheral surface of the roll, (b) a plurality of cutting elements, each of said cuttings elements including a base member receivable within said slot and wherein said base member and said slot are dimensioned to allow the insertion of shims in underlying engagement and support to the cutting elements for permitting the extent of the projection of said cutting elements from the circumference of the roll to be varied by the placement of shims within said slots.

10. Apparatus for forming wood shavings from wood stock, comprising:

a rotatable cutting roll having a generally cylindrical peripheral surface, and a plurality of cutting elements projecting from said surface and defining a cutting circle for engaging and cutting wood shavings from the leading edge portion of wood stock advanced along a predetermined path of travel to said roll, and an anvil formed of a material cutable by said cutting elements of said cutting roll and being positioned adjacent the end of said path of travel and closely adjacent said cutting roll for restricting advancement past said cutting roll of pieces of said wood stock other than said shavings and wherein said anvil has a concave surface confronting and closely adjacent said cutting circle of said cutting roll, mounting means mounting said concave surface of said anvil for adjustive movement of said concave surface toward and away from said cutting roll, and further including feed means adjacent said path of travel for controlling the advancement of the wood stock along said path of travel, said feed means including a first feed roll mounted for rotation closely adjacent said path of travel, said first feed roll having peripheral teeth engageable with the wood stock advanced along said path of travel, said teeth being inclined rearwardly relative to the direction of rotation of said first feed roll such that said teeth have a negative rake angle, and wherein said negative rake angle is in the range of 5° to 20°.

11. The apparatus as claimed in claim 10 wherein said first feed roll is positioned so that the resultant force vector of said cutting elements on the leading edge portion of wood stock advanced along a predetermined path of travel to said roll is in a direction toward said first feed roll.

12. The apparatus as claimed in claim 10, and further including drive means for during operation of said apparatus imparting rotation to said cutting roll and to said first feed roll of said feed means.

13. The apparatus as claimed in claim 12 wherein said drive means synchronizes the peripheral speeds of said cutting roll and said feed roll such that the leading edge of the wood stock engages said cutting elements projecting from said surface of said cutting roll without engaging said peripheral surface thereof.

14. The apparatus as claimed in claim 13 wherein said drive means rotates said first feed roll at a peripheral speed less than the peripheral speed of said cutting roll.

15. The apparatus as claimed in claim 13 wherein said drive means includes at least one adjustable variable speed drive mechanism for rotating said first feed roll at different selected speeds.

16. The apparatus as claimed in claim 10 wherein said first feed roll underlies and is closely adjacent said cutting roll.

17. The apparatus as claimed in claim 10 wherein said first feed roll underlies said path of travel.

18. The apparatus as claimed in claim 10 wherein said feed means further includes at least a second feed roll having teeth with a negative rake angle.

19. The apparatus according to claim 10 wherein said feed means further includes a fixed, substantially planar bed upon which the wood stock rests during advancement thereof along said path of travel, said peripheral teeth of said first feed roll extending above said surface of said bed for engaging the wood stock resting thereon.

20. The apparatus according to claim 10 wherein said feed means includes a fixed, substantially planar bed upon which said wood stock rests during advancement thereof along said path of travel, said cutting roll being mounted for rotation above said bed so that only a lower portion of said cutting roll cutting surface extends below the plane of said bed.

21. The apparatus according to claim 10 wherein said cutting roll includes (a) a plurality of slots within and spaced about the peripheral surface of the roll, (b) a plurality of cutting elements, each of said cutting elements including a base member receivable within said slot and wherein said base member and said slot are dimensioned to allow the insertion of shims in underlying engagement and support to the cutting elements for permitting the extent of the projection of said cutting elements from the circumference of the roll to be varied by the placement shims within said slots.

22. A cutting roll adapted for use in a wood shaving forming apparatus comprising (a) a roll member having a generally cylindrical peripheral surface and a plurality of slots extending longitudinal of the axis of the roll within and spaced about the peripheral surface of said roll member, (b) a plurality of cutting elements mounted within each of said slots, each cutting element including a base member receivable within one of said slots, each base member having a top surface, and including a carbide blade extending obliquely across the top surface of each base member, and a chip gullet positioned adjacent to the carbide blade and extending substantially parallel therewith for receiving shavings therein during chip formation and wherein said base member and said slot are dimensioned to allow the insertion of shims in underlying engagement and support to the cutting elements for permitting the extent of the projection of said cutting elements from the circumference of the roll to be varied by the placement shims within said slots and wherein said cutting elements are positioned in said longitudinal slots so that adjacent gullets are oblique to each other.

* * * * *